United States Patent [19]

Lewis

[11] Patent Number: 4,934,614

[45] Date of Patent: Jun. 19, 1990

[54] ROTARY GRINDING APPARATUS WITH SECONDARY GRINDING CHAMBER SECTION

[75] Inventor: Herbert H. Lewis, Jacksonville Beach, Fla.

[73] Assignee: Newman Machine Company, Inc., Greensboro, N.C.

[21] Appl. No.: 391,467

[22] Filed: Aug. 9, 1989

[51] Int. Cl.[5] ..... B02C 13/284

[52] U.S. Cl. ..... 241/73; 241/80; 241/97

[58] Field of Search ..... 241/73, 74, 80, 96, 241/86.1, 189 R, 97

[56] References Cited

U.S. PATENT DOCUMENTS 4,544,105 10/1985 Carlsson ..... 241/73

FOREIGN PATENT DOCUMENTS 558654 6/1958 Canada .

1173774 7/1964 Fed. Rep. of Germany ..... 241/73

2527477 12/1983 France ..... 241/73

*Primary Examiner*—Timothy V. Eley

*Attorney, Agent, or Firm*—Bell, Seltzer, Park & Gibson

[57] ABSTRACT

The grinding chamber of the apparatus has first and second grinding sections having perforate wall sections overlying the outlet of the apparatus. The perforate wall of the first grinding section underlies the rotor of the apparatus and has an arcuate shape. The perforate wall of the second grinding section extends generally tangentially upwardly and outwardly from the downstream end of the perforate wall of the first grinding section. The second grinding section is larger than the first, and may include breaker bars which deflect the material being ground toward the perforate wall of such section.

11 Claims, 1 Drawing Sheet

ROTARY GRINDING APPARATUS WITH SECONDARY GRINDING CHAMBER SECTION

FIELD OF THE INVENTION

This invention relates to rotary grinding apparatuses, such as are used for grinding or similarly comminuting scrap material such as wood or other material, that include a rotor assembly mounted for rotation in a grinding chamber having a perforate bottom wall through which the scrap material passes after being sufficiently reduced in size by the apparatus. The invention more specifically relates to an improved grinding chamber, having a plurality of grinding sections, for a rotary grinding apparatus.

BACKGROUND OF INVENTION

In known grinding apparatuses of the above-described general type, the output and efficiency of the apparatus fingers is limited by the number and size of the holes within the perforate wall of the grinding chamber and by the length of such wall. The hole size is normally dependent upon the size to which the scrap material must be reduced by the grinding apparatus, and thus cannot be increased beyond such size. In most of the apparatuses the arcuate and perforate grinding chamber wall which underlies part of the rotor within the chamber, and through which the scrap material must eventually pass in order to be discharged from the apparatus, is of short length, extending through an arc of less than 180°. In addition to limiting the production and efficiency of the apparatuses, the restricted nature of their discharge path also significantly increases the frequency with which their wearable components, such as breaker bars and breaker teeth or hammers, must be replaced. This in turn increases downtime and maintenance costs.

SUMMARY OF THE INVENTION

The present invention provides a scrap-grinding apparatus whose grinding chamber has first and second sections each bordered by perforate walls. The perforate wall of the first grinding section closely underlies the rotor of the apparatus and has an arcuate shape complementary to that of the rotor. The second section of the grinding chamber is downstream, in relation to the inlet and to the direction of rotation of the rotor of the apparatus, from the first section. The perforate wall of the second grinding section extends upwardly and outwardly from a location adjacent the rotor and the downstream end of the perforate wall of the first grinding section. The perforate walls of both sections of the grinding chamber overlie an outlet that receives the ground material passing through the perforations of such walls.

In a preferred embodiment of the invention, the perforate wall of the second chamber section is connected to the downstream end of the perforate wall of the first grinding section, and extends substantially tangentially therefrom at an angle of approximately 30° relative to the vertical; and breaker bars are provided at various locations within the grinding chamber. In addition to cooperating with breaker teeth or hammers upon the rotor of the apparatus, at least some of the breaker bars are so located as to assist in deflecting scrap material engaged thereby toward the perforate wall of the second chamber section.

DESCRIPTION OF THE PRIOR ART

U.S. Pat. Nos. 2,869,793 and 3,473,742 disclose rotary grinding apparatuses, for grinding or similarly reducing scrap material, having perforate grinding chamber walls or the like underlying their rotor components.

U.S. Pat. No. 3,887,141 discloses an impact-attrition mill for reducing the size of chunks of ore. The apparatus includes a secondary reduction chamber downstream from a first chamber.

DESCRIPTION OF THE DRAWINGS

Preferred embodiments of the invention are illustrated in the accompanying drawings, in which.

DESCRIPTION OF THE ILLUSTRATED EMBODIMENTS

Figure 1:
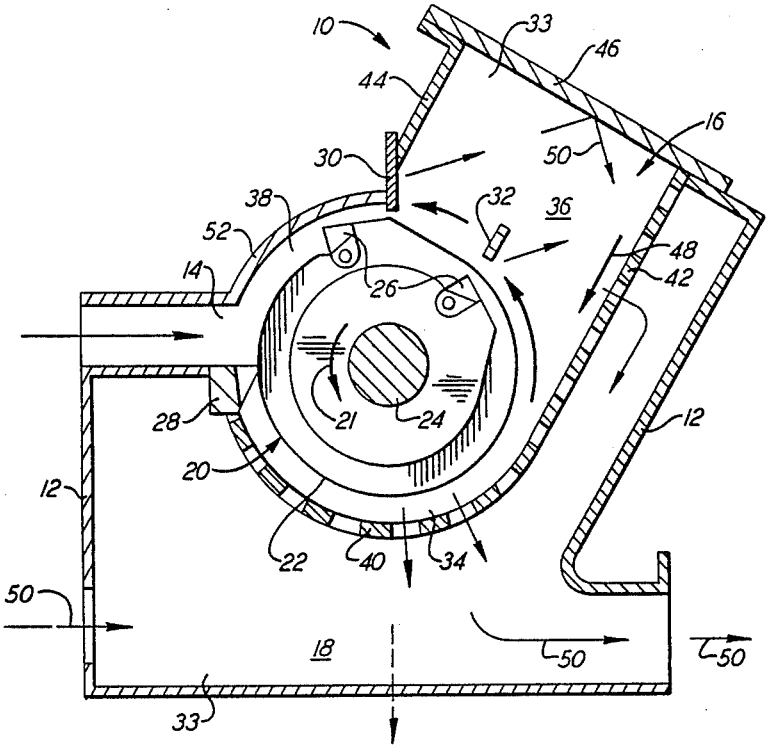
FIG. 1 is a partially schematic view, primarily in vertical section with some components being shown in side elevation, of a front-loading grinding apparatus in accordance with the invention.

Referring more particularly to the drawings, the numeral 10 in FIG. 1 designates a rotary grinding apparatus whose housing 12 has an inlet 14 through which wood or similar scrap material (not shown) to be ground is introduced, a grinding chamber 16 within which grinding or other comminution of the scrap material occurs, and an outlet 18 via which the scrap material passes from the apparatus following sufficient reduction in size thereof. Chamber 16 and outlet 18 are bordered at opposite ends thereof by end walls 33 (only one of which is shown in FIG. 1) of housing 12.

A rotor 20 is mounted by suitable bearings (not shown) within chamber 16 for rotation, in the direction indicated by the arrow 21 and during operation of apparatus 10, under the impetus of a suitable drive motor (not shown) drivably connected thereto. A plurality of breaker rings 22, only one of which is shown in FIG. 1, are mounted in laterally adjacent relationship to each other upon rotor shaft 24 for rotation therewith. The illustrated breaker ring 22 is of the type having large and small diameter portions which carry tooth-like breaker members 26 that during operation of the apparatus move in unison with breaker ring 22. However, the breaker rings and breaker members might instead be of other types.

Apparatus 10 preferably and illustratively further includes a plurality of elongate stationary breaker bars 28, 30, 32 that extend substantially parallel to and are approximately coextensive in length with the rotor 20. The breaker bars are fixedly connected to opposite end walls 33 of housing 12. During operation of apparatus 10 the breaker members 26 of rotor 20 pass closely adjacent the breaker bars, and also closely adjacent certain walls of chamber 16. Scrap material (not shown) introduced into apparatus 10 through inlet 14 is propelled by rotor 20 about its central axis in the direction of arrow 21, and during such movement is impacted and reduced in size by its contact with breaker members 26, breaker bars 28, 30, 32 and/or walls of grinding chamber 16.

Grinding chamber 16 has a plurality of sequential grinding sections 34, 36, 38 at spaced locations about the circumference of rotor 20. The first or primary grinding section 34 has a perforate arcuate wall 40 that underlies and is concentric with rotor 20. Wall 40 extends from a location closely adjacent housing inlet 14 and breaker bar 28 through an arc-distance of approximately 120°, and overlies scrap material outlet 18 of apparatus 10. Some, but normally not all, of the scrap material which is of a small enough size to do so will pass from primary section 34 to outlet 18 via the openings of perforate wall 40. The other scrap material within grinding section 34 is conducted by rotor 20 from the downstream end of such section and into the adjoining second grinding section 36.

Section 36 has a perforate wall 42, and imperforate walls 44, 46. Wall 46 may be removable to provide access to the interior of the chamber section, and to the breaker bars 30, 32 mounted therewithin. Wall 42, which also overlies scrap material outlet 18, preferably and illustratively is connected to the downstream end of wall 40 and extends substantially tangentially upwardly and outwardly therefrom. The angle of wall 42 relative to the vertical, illustratively approximately 30° degrees, is such that scrap material engaging the inner surface of the wall will pass through the openings of the wall, if of a size smaller than such openings, and if of a larger size will move downwardly along the inner face of the wall, as indicated by the arrow 48, back toward primary grinding section 34 and into re-engagement with rotor 20. Part of the scrap material exiting from the downstream end of primary grinding section 34 will pass more or less directly into engagement with the inner surface of wall 42. As is indicated by the arrows 50, other of the material will follow a less direct route, and be deflected into engagement with wall 42 after engaging one of the breaker bars 30, 32 and/or one of the imperforate chamber walls 33, 44, 46. Contact of scrap material with perforate wall 42 is also enhanced by the considerable size of grinding section 36, which has a radial dimension and volume at least several times that of section 34. This allows the scrap material to assume a less dense and more "fluid" condition which facilitates its free movement and thus increases contact thereof with the walls and breaker bars of the chamber section.

A considerable amount of the scrap material introduced into chamber section 36 passes therefrom, either immediately or after further size reduction in such chamber section, through perforate wall 40 into the underlying outlet 18 of apparatus 10. Such scrap material, along with that received by outlet 18 from grinding section 34, may be discharged from outlet 18 in any suitable manner, for instance by a flow of pressurized air such as is indicated by the arrows 50.

Scrap material not discharged from grinding section 36 via perforate wall 42 is conducted by rotor 20 into a third chamber section 38. Section 38 has an imperforate arcuate wall 52 that is concentric with rotor 20 and that extends to inlet 14 of apparatus 10. The material passing from the downstream end of grinding section 38 again passes, with any new material then being introduced into apparatus 10 via inlet 14, into the first or primary section 34 of grinding chamber 16. The amount of scrap material that undergoes such "recycling" is significantly reduced by the inclusion in apparatus 10 of secondary grinding chamber section 36 and its perforate wall 42. Consequently, the efficiency and durability of the apparatus is enhanced.

Figure 2:
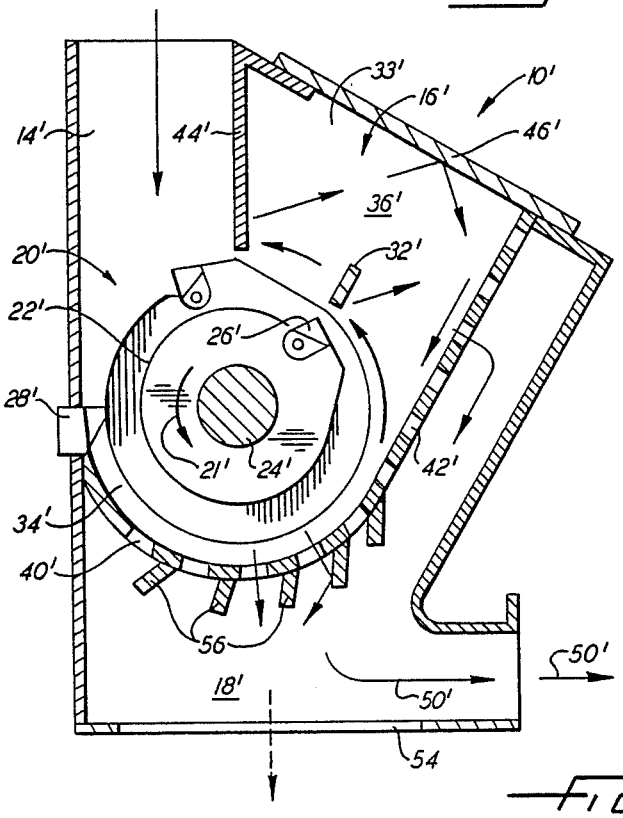
FIG. 2 is a view similar to FIG. 1 of a top-loading grinding apparatus in accordance with the invention.

The apparatus 10' of FIG. 2 is similar to the apparatus 10 of FIG. 1, and corresponding components are designated by the same reference numerals with the addition of a prime designation. The scrap material is introduced into apparatus 10' through an inlet 14' that extends vertically, rather than horizontally, and ground scrap material is removed from outlet 18' of apparatus 10' by a suction-induced air flow indicated by the arrows 50', or by gravity discharge through an opening 54 within the bottom of apparatus 10'. Apparatus 10' has no third grinding chamber, such as chamber 38 of apparatus 10 (FIG. 1). Secondary grinding section 36' of chamber 16' terminates immediately adjacent material inlet 14' and the aforesaid chamber section illustratively contains only one breaker bar 32', Deflector elements 56 of a known type project angularly downwardly from perforate wall 44' of grinding section 34', to discourage passage through such wall of undesirably long lengths of scrap material. In all other respects the construction and mode of operation of apparatus 10' are substantially the same as that of apparatus 10 of FIG. 1.

While preferred embodiments of the invention have been specifically shown and described, this was for purposes of illustration only, and not for purposes of limitation, the scope of the invention being in accordance with the following claims.

I claim:

1. Apparatus for grinding scrap material, comprising:

a housing having a grinding chamber, an inlet through which the scrap material is introduced into said chamber, and an outlet through which the scrap material is discharged following grinding thereof;

a rotor mounted within said chamber for rotation about a central axis during operation of said apparatus, said rotor including at least one breaker member mounted adjacent the periphery of said rotor for engagement with the scrap material during operation of said apparatus;

said grinding chamber having a first grinding section and a second grinding section;

said first grinding section of said chamber being in downstream adjacent relationship to said inlet and including an arcuate perforate wall extending in underlying generally concentric adjacent relationship to said rotor;

said second grinding section of said chamber being located downstream from said first section and upstream from said inlet and including laterally spaced side walls and an outer wall interconnecting outer end portions of said side walls, said outer wall and one of said side walls being imperforate, the other of said side walls extending angularly upwardly and outwardly from a location closely adjacent said rotor and said perforate wall of said first grinding section, and being perforate along substantially its entire length;

said outlet of said housing being adjacent said perforate walls of both of said grinding sections and receiving scrap material passing from said grinding sections through said perforate walls thereof.

2. Apparatus as in claim 1, and further including a breaker bar mounted within said first grinding section adjacent said inlet and said rotor, and wherein said outlet underlies said perforate wall of said first grinding section and said other of said side walls of said second grinding section.

3. Apparatus as in claim 2, wherein said second grinding section extends further outwardly from said rotor than said first grinding section, and further including a breaker bar mounted within said second grinding section of said chamber in spaced relationship to said imperforate and perforate side walls thereof.

4. Apparatus as in claim 3, and further including a second breaker bar within said second grinding section of said chamber, said breaker bars within said second grinding section of said chamber being relatively close to said rotor and distal from said perforate wall of said second grinding section of said chamber.

5. Apparatus as in claim 4, wherein said grinding chamber further includes a third grinding section downstream of said second grinding section and upstream of said inlet, said third grinding section having an imperforate wall extending in substantially concentric adjacent relationship to said rotor.

6. Apparatus as in claim 5, wherein said housing has a front wall, and said inlet is substantially horizontal and opens from said front wall of said housing.

7. Apparatus as in claim 5, wherein said housing has a top wall, and said inlet extends generally vertically and opens from said top wall of said housing.

8. Apparatus as in claim 1, wherein said perforate walls of said grinding sections are connected to each other, and said perforate wall of said second grinding section extends substantially tangentially relative to said perforate wall of said first grinding section.

9. Apparatus as in claim 1, wherein said imperforate one of said side walls of said second grinding section of said chamber extends generally parallel to said perforate wall of said second chamber section and is adapted to deflect scrap material engaged thereby toward said perforate wall of said second grinding section.

10. Apparatus as in claim 9, wherein said perforate wall of said second grinding section extends at an angle of approximately 30° relative to the vertical.

11. Apparatus as in claim 10, wherein said second grinding section has a volume substantially greater than that of said first grinding section.

* * * * *